US005669297A

United States Patent [19]

Verhoefen

[11] Patent Number: 5,669,297

[45] Date of Patent: Sep. 23, 1997

[54] CUTTING AND SHAPING PRESS WITH ONE OR MORE CYLINDERS AND A HINGED LEVER DRIVE

[76] Inventor: Ulrich Verhoefen, Schillerstrasse 6a, D-6466 Gründau 2, Germany

[21] Appl. No.: 789,410

[22] Filed: Jan. 29, 1997

Related U.S. Application Data

[63] Continuation of Ser. No. 79,058, Jun. 21, 1993, abandoned.

[30] Foreign Application Priority Data

Jun. 22, 1992 [DE] Germany ..... 42 20 043.1

[51] Int. Cl.[6] ..... B30B 1/16

[52] U.S. Cl. ..... 100/257; 72/451; 83/630; 100/272; 100/286

[58] Field of Search ..... 100/257, 272, 100/285, 286; 72/451; 83/626, 630

[56] References Cited

U.S. PATENT DOCUMENTS

| | | | |
|---|---|---|---|
| 716,319 | 12/1902 | Webb | 100/286 X |
| 986,809 | 3/1911 | Derbyshire et al. | 100/257 X |
| 4,579,031 | 4/1986 | Lash et al. | 83/630 X |
| 4,660,452 | 4/1987 | Leinhaas | 100/286 X |
| 4,876,878 | 10/1989 | Scheitza | 100/286 X |

FOREIGN PATENT DOCUMENTS

| | | |
|---|---|---|
| 0250610 | 4/1990 | European Pat. Off. . |
| 2925416 | 1/1981 | Germany . |
| 2949966 | 6/1981 | Germany . |

*Primary Examiner*—Stephen F. Gerrity
*Attorney, Agent, or Firm*—Lane, Aitken & McCann

[57] ABSTRACT

A cutting and shaping press comprises one or more drivers. The piston rod of the individual drive cylinder is connected to a hinged lever drive for a press ram. The drive cylinder is fixed on a bridge which connects two slide plates together. These slide plates are arranged inside the press ram and each have in the center a guide for a multiple pivot carrier. The press ram is open upwardly towards the drive cylinder and slide with its lateral surfaces, which are enclosed on all sides, along guides which are fitted in fixed positions on the inner sides of a press stand.

16 Claims, 3 Drawing Sheets

CUTTING AND SHAPING PRESS WITH ONE OR MORE CYLINDERS AND A HINGED LEVER DRIVE

This application is a continuation of application Ser. No. 08/079,058, filed Jun. 21, 1993 now abandoned.

BACKGROUND OF THE INVENTION

This invention relates to a cutting and shaping press with one or more drive cylinders and a hinged lever drive for a press ram, in which the drive cylinder(s) is or are connected to a bridge, with two threaded spindles which are adjustable in height passing through a press stand, the spindles positioning bearing blocks fitted on their ends, which blocks provide pivot points for the hinged lever drive inside the press ram.

Such a cutting and shaping press with a hydro-mechanical hinged lever drive is known from EP-B 0 283 532. In this shaping press, the drive cylinder for the press ram is supported by a bridge structure arranged in the stand between lateral guides and connected to the bridge structure by threaded spindles or other structure which are adjustable in height, the bridge structure being supported inside the clear region of the frame-like press stand. The bridge structure connects the bearing pivots arranged symmetrically on the two sides of the press central position and accepts a central guide for the piston rod through a first pivot point. The two bearing pivots form, together with further connected pivot points, a rigid, pivoting triangle, whose pivot point facing towards the center of the press ram leads in each case through at least two drive lever parts coupled at a second pivot point to the first pivot point, which is movable in the direction of the central guide. The second pivot point continues in the lower region of the central guide into a separate curve, and the pivot points of the triangle are connected by a continuing lever part to the press ram.

In EP-B 0 250 610 there is described a hinged lever cutting and shaping press formed from a single or multiple press stand and at least one press ram formed as a rule like a closed frame, which is connected to the pressure medium cylinder drive—in each case between two hinged, symmetrically like hinged lever system with their pivots folding out towards the center of the press. The piston of the pressure medium cylinder drive is connected by means of the end of its piston rod to the multiple pivot carrier, which is guided in the press stand and on which at least two links are movably arranged, these links being for their part pivotally mounted adjustable in height on the press frame and directed towards the press table in the press ram. The relationship applying to the pressure medium cylinder drive is that the stroke of the piston is equal to the stroke of the multiple link, if desired less the stroke of the press ram. A particular form of press results from this structure; namely a so-called "differential stroke press", which is to be so further developed that the working range of the press ram is adjustable within relatively wide limits independently of the ram stroke with unrestricted maintenance of the ram guiding and that the stand construction minimizes the give of the press stand to an amount approaching zero, in the interests of high cutting accuracy. To this end it is arranged that the press stand is a double stand frame partially closed at the front and the rear, and that synchronously drivable spindles, which are supported through threaded guides in the upper transverse support of the press stand, end in spindle bearings provided on both sides of the press stand, forming a guide traverse which is adjustable in height, and in that the guide traverses are provided on the underside with pivot bearings for the suspended arrangement of the link lever pair connected to the press ram. In this connection the press ram is formed as a frame and is connected directly to the pressure medium cylinder drive, as is desired in differential stroke presses.

From DE-C 2 925 416 there is known a cutting press with a pressure medium cylinder drive arranged between two knee lever systems whose knee joints kink out towards the press center and symmetrically alike relative thereto, the piston of which drive engages at the end with the connecting joint of two links in the press center, the other ends of the links being pivoted to the knee lever system, where the connecting joint is guided transverse to the direction of the piston rod with the aid of the press stand. The pressure medium cylinder drive bears directly on the press ram, the cylinder being fixed to the press ram. The press ram is formed as a frame in which the pressure medium cylinder drive can inter alia be fitted.

In the known shaping and cutting presses, the guide for the end of the piston rod supported in the press stand must be lined up in position with the ram. This work of adjustment is, however, expensive and is needed every time the ram is fitted in the press stand and after possible maintenance work.

The object of the invention is to improve a cutting and shaping press of the kind initially described, so that the press ram experiences a smaller cant of the ram with off-center loading, with a lighter construction than in known press rams, so that the ram deformations can be kept very small.

SUMMARY OF THE INVENTION

This object is met according to the invention in that a multiple pivot carrier connected to the piston rod of the drive cylinder is guided in the press ram.

In a development of the invention, the press ram is open towards the drive cylinder and slides, with its lateral surfaces closed on all sides, along guides which are fitted in fixed positions on the insides of and near the corners of the press stand. Furthermore, slide plates are arranged parallel to the longitudinal sidewalls of the press ram, in the interior thereof, and each slide plate has a central guide for the multiple pivot carrier and is supported in the press ram.

An intermediate floor running continously above the pivot point of the connecting rod articulated to the ram gives the ram a very great torsional stiffness.

In a further development of the invention, the central guides are formed as grooves in the slide plates.

The advantage obtained by means of the invention is that a smaller tilting moment than with known cutting and shaping presses is transmitted to the press ram. Furthermore, the press ram per se is very rigid. The closed and ribbed sidewalls hardly deform at all, in contrast to the known frame-form rams, whose sides deflect and which deform like parallelograms with off-center ram loading. The slide plates guided inside the ram in which the guides for the end of the piston rod are fitted reduce the tilting moment acting on the ram especially, with off-center ram loading through their reaction forces acting on the ram, and thus additionally reduce its cant. Moreover, the adjustment work on the position of the piston rod guides relative to the ram is obviated.

The free horizontal force acting on the ram is compensated by the multiple pivot carrier passing in the press ram. Thus, the ram is balanced with regard to the force at any time and in any position of the off-center loading of the press in the horizontal direction. Therefore, no free transverse forces act on the ram. With off-center loading of the press, the tilting moment acting on the ram is reduced.

The smaller ram deformations, the smaller canting of the ram and the guaranteed correct position of the piston rod guide relative to the ram each act advantegously on the tool down time. The sliding of the ram along the guides leads by itself to an alignment of the multiple pivot carrier with regard to the driving system. A perfect shifting process of the ram is given without any additional expenditure. This is also the case after any necessary repair works or revisions.

It is also an advantage that a greater usable press ram surface results, since essential parts are arranged inside the press ram. Since the press ram is laterally closed on all sides, the penetration of cutting oil and dirt into the lubricating circuit of the cutting and shaping press is prevented.

The ram, upwardly open and laterally enclosed on all sides, does not deform, especially if it is provided with an intermediate floor. An additional dislocation of the stamp and of the die does not result. The ram enclosing the driving system on all sides extraordinarily avoids the penetration of cutting oil and dirt into the driving system. Moreover, the ram provides, for structural reasons, an essentially larger depth of the clamping area for the top of the tool.

A further advantage consists in that the guides of the press ram are structurally simple to make.

DETAILED DESCRIPTION OF THE PREFERRED EMBODIMENTS

Figure 1:
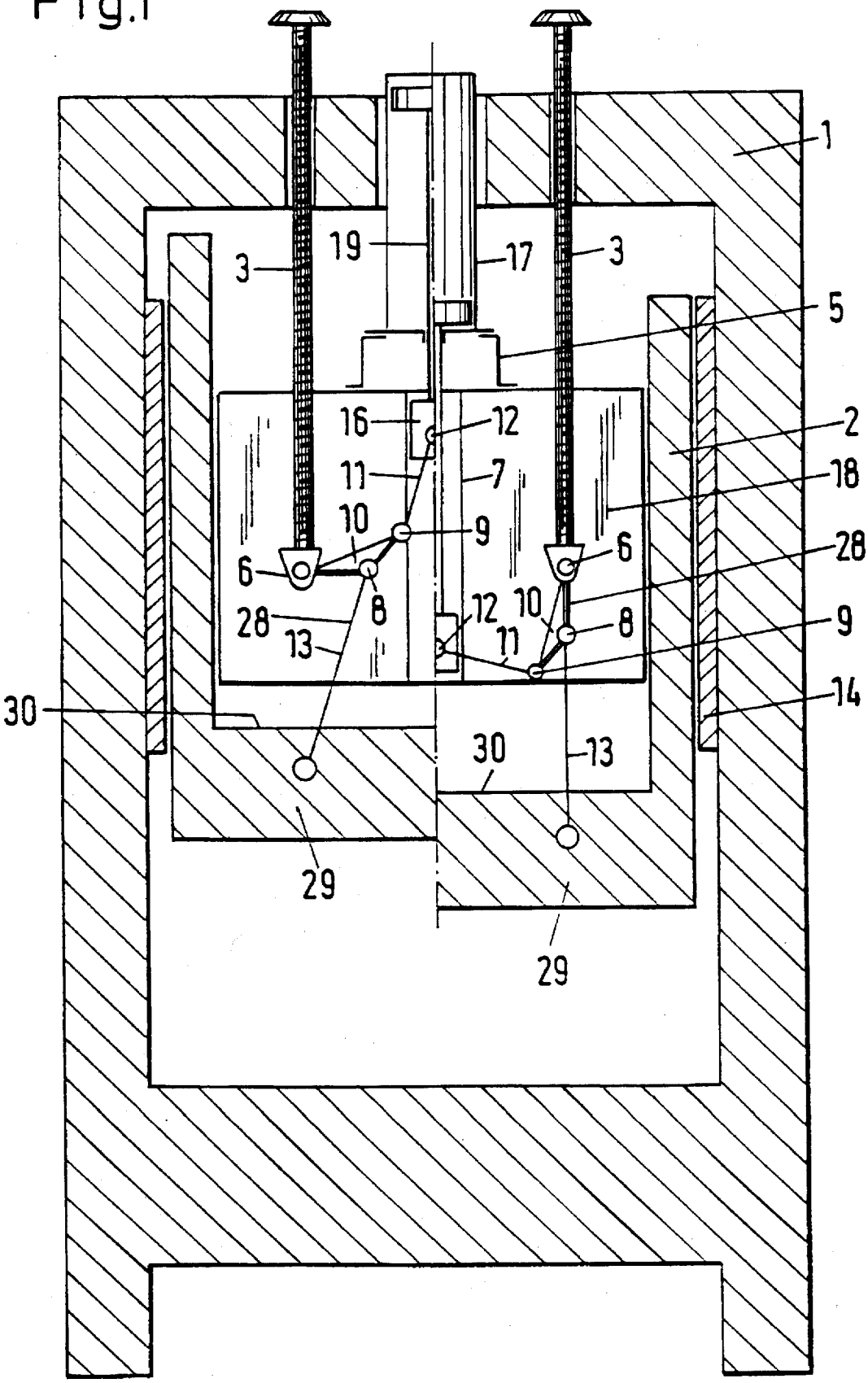
Figure 2:
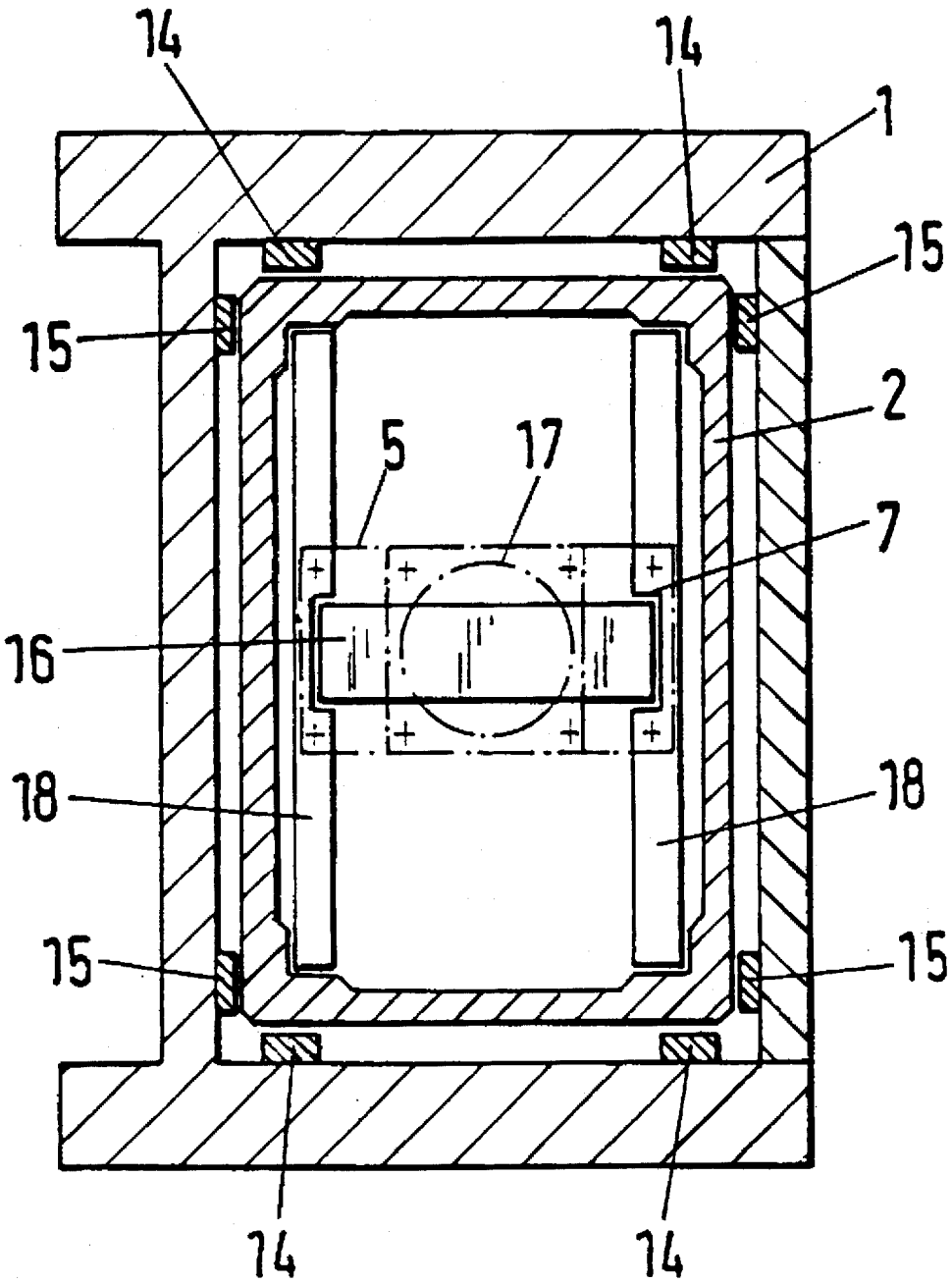
Figure 3:
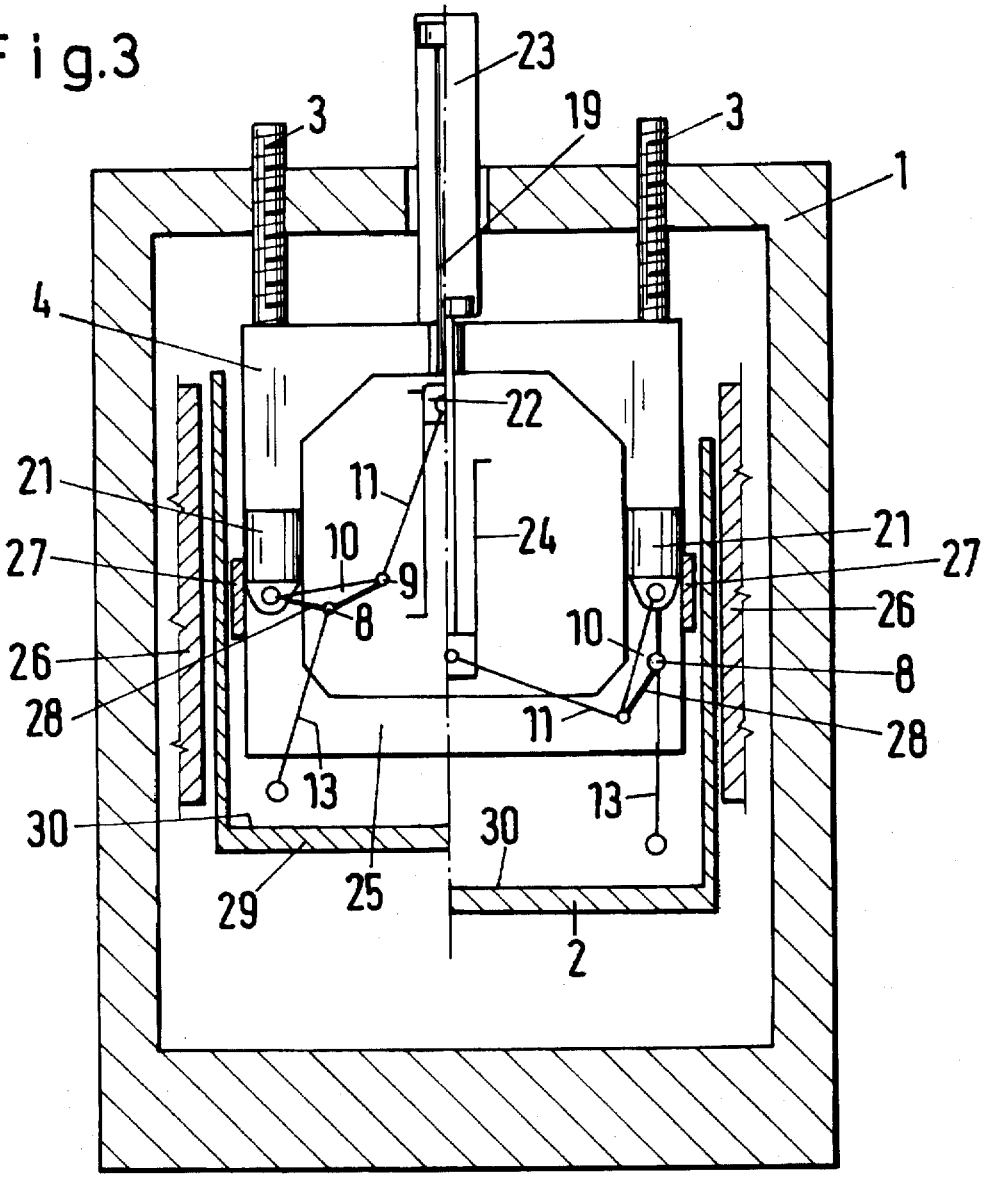
Figure 4:
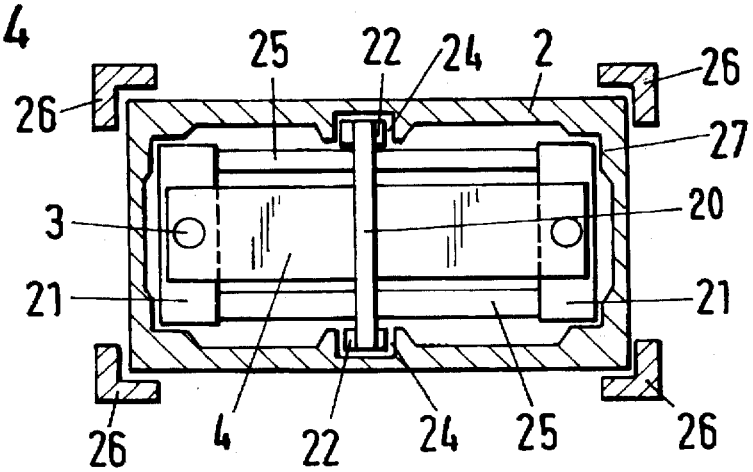

The invention will be explained in more detail with reference to two embodiments shown in the drawings, in which:

FIG. 1 is a view in section of a first embodiment of the invention equipped with slide plates, FIG. 2 is a plan view in section through the first embodiment according to FIG. 1, FIG. 3 is a view in section of a second embodiment of the invention, in which no slide plates are provided, and FIG. 4 is a plan view in section through the second embodiment according to FIG. 3.

The cutting and shaping press shown in FIGS. 1 and 2 comprises a press stand 1 which in outline consists of a yoke-shaped part and a wall connected to this yoke-shaped part (cf. FIG. 2). Two threaded spindles 3, 3 adjustable in height and a drive cylinder 17 extend through the press stand 1. The drive cylinder 17 is connected to a hinged lever drive 28 for a press ram 2. Two or more drive cylinders could also be provided.

In FIG. 1, the left half of the drawing represents the upper dead point of a piston rod 19 of the drive cylinder 17 and the right half represents the lower dead point of the piston rod 19 of the drive cylinder 17. At the lower end of the threaded spindles 3, 3 there are arranged bearing blocks 6, which are provided with a pivot. By adjusting the height of the threaded spindles 3, 3 in the press stand 1, the bearing blocks 6 with their pivots are adjusted in height within the press ram 2, the current position of the threaded spindles 3, 3 being determined by the thickness of the material to be shaped or cut or of the tool. As to the spindles 3, 3, it is to be noted that they are obviously always positioned at the same height as one another. The two symmetrically formed branches of the hinged lever drive 28 are articulated to the pivots on the bearing blocks 6. Each of the two symmetrically formed branches consists of a first connecting rod 11, which is connected to a three-pivot lever 10, and of a second connecting rod 13, which is connected at one end to a pivot 8 of the three-pivot lever 10 and at the other end to the press ram 2. The first connecting rod 11 is connected through a pivot 12 to a multiple pivot carrier 16 at one end and through a pivot 9 to the three-pivot lever 10. The articulation of the second connecting rod 13 is effected at the press ram 2. Above the point of articulation of the connecting rod 13 pivoted to the ram there is a continuous intermediate floor 30, which gives the ram a very great torsional stiffness.

The press ram 2 is open upwardly in the direction of the drive cylinder 17 and is closed laterally on all sides. The closed side surfaces of the press ram 2 slide along guides 14, 15 (cf. FIG. 2), which are fitted at fixed positions on the insides of the press stand, near the corners of the press stand 1. Within the press ram 2, there are arranged slide plates 18, 18 which extend parallel to the longitudinal sidewalls of the press ram 2. Each of these slide plates 18 comprises a guide 7 in the center for the multiple pivot carrier 16 and is supported in fixed position in the press ram 2. Through this kind of guiding of the multiple pivot carrier 16 in the supported guide plates 18, it is ensured that, with off-center loading of the press ram, the lateral forces of the multiple pivot carrier 16 are absorbed without large tilting moments, so that there is hardly any canting of the press ram. The multiple pivot carrier 16 connected to the piston rod 19 of the drive cylinder 17 is so guided in this manner in the press ram 2 that, even with off-center loading of the press ram 2, only a very small tilting moment is transmitted to the press ram. The press ram 2 may also be closed upwardly in the direction of the drive cylinder.

The guides 7 in the guide plates 18, 18 are formed as grooves. The drive cylinder 17 is fixed on a bridge 5 which connects the two slide plates 18, 18 together.

FIGS. 3 and 4 show the second embodiment of the invention, which relates to a cutting and shaping press which is not fitted with slide plates. Like components as in the first embodiment are given the same reference numerals, and the description thereof is not repeated. In this second embodiment also the press ram 2 is open upwardly and slides with its lateral faces closed on all sides along guides 26, which are fitted in fixed positions on the insides of the press stand 1.

The guides 26 are arranged near the corners of the press stand 1 and are formed for example as angle brackets, which fit angularly around the corners of the press ram 2. A drive cylinder 23 is connected through its piston rod 19 to a multiple pivot carrier 20, which is guided in the press ram 2. The two symmetrically formed branches of the hinged lever drive 28 are pivoted to the multiple pivot carrier 20 through a first connecting rod 11. The first connecting rod 11 is articulated to a three-pivot lever 10, which is pivoted at one end to the threaded spindle 3 and at the other end to a second connecting rod 13, which is pivoted on a press and cutting plate 29 of the press ram 2.

The upper dead point of the piston rod 19 is shown in the left half of FIG. 3, the lower dead point in the right half of the drawing.

At the ends of the multiple pivot carrier 20 there are slide blocks 22, 22, as can be seen from FIG. 4. These slide blocks 22, 22 are guided in slide block guides 24, 24, which are arranged in the center of the longitudinal sidewalls of the press ram 2. The drive cylinder 23 sits on a bridge 4, which extends parallel to the longitudinal sides of the press ram 2 and has bearing blocks 21, 21 on its underside, the bearing blocks being connected together by means of struts 25. The bridge 4, the bearing blocks 21, 21 and the struts 25 form a frame, on whose narrow sides external abutments 27 are fitted, the external abutments holding the frame within the press ram 2. The bearing blocks 21, 21 arranged on the narrow sides of the bridge 4 are supported in the press ram 2 and run parallel to the multiple pivot carrier 20, which is fitted or guided centrally in the press ram 2, as already mentioned above. Since the relatively heavy slide plates are omitted in this second embodiment, the drive of the press ram can be of smaller dimensions than in the first embodiments with the slide plates.

Although not shown in the drawings, the slide plates according to FIGS. 1 and 2 could be replaced in a further embodiment by tie rods, when the guiding of the multiple pivot carrier is effected likewise directly, similar to the second embodiment according to FIGS. 3 and 4.

Because of the faces of the press ram 2 are closed on all sides, the press ram has great stiffness. The great torsional stiffness of the ram is obtained through an intermediate floor 30. Thus, even off-center loads are absorbed without large deformations and canting of the ram.

I claim:

1. A cutting and shaping press comprising a press ram, a press stand, at least one drive cylinder having a piston rod, and a hinged lever drive having at least two knee lever systems connected to the ram and symmetrically arranged with respect to a vertical center plane of the ram, the knee lever systems having fixed points and at least two threaded spindles adjustable in height in the press stand and positioning bearing blocks fitted on ends of the threaded spindles for pivoting one of the fixed points of each of the knee lever systems, the press further comprising a slide device within the press ram, a multiple pivot carrier connected to the piston rod of the drive cylinder, and a connecting rod connecting the multiple pivot carrier to a knee joint of each of the knee lever systems, characterized in that the multiple pivot carrier is guided by a structure in the press ram and that the slide device connected to said bearing blocks is supported in the press ram.

2. A cutting and shaping press according to claim 1, characterized in that said slide device is defined by a bridge having ends and bearing blocks at said ends, the bearing blocks sliding in the press ram.

3. A cutting and shaping press according to claim 2, characterized in that the press ram has closed sides and an intermediate floor.

4. A cutting and shaping press according to claim 2, characterized in that the bearing blocks are on the underside of said bridge, and the bridge, the bearing blocks, and struts connecting the bearing blocks with one another comprise a frame having narrow sides on which external supports are fitted which hold the frame within the press ram.

5. A cutting and shaping press according to claim 4, characterized in that the bearing blocks extend parallel to the multiple pivot carrier, which is arranged centrally in the press ram.

6. A cutting and shaping press according to claim 4, characterized in that the press ram is guided in guides which are angle brackets fitting around corners of the press ram.

7. A cutting and shaping press according to claim 1, characterized in that the press ram has an upper edge, and the press ram has sides, all of the sides of the press ram consisting of closed surfaces extending up to the upper edge of the press ram.

8. A cutting and shaping press according to claim 1, characterized in that the multiple pivot carrier has ends and slide blocks at said ends, said press ram has longitudinal sidewalls, and said slide blocks are guided in block guides in the longitudinal sidewalls of the press ram.

9. A cutting and shaping press according to claim 1, characterized in that the knee lever systems are each pivoted at the multiple pivot carrier with at least a first connecting rod, wherein said first connecting rod is connected to a three-pivot lever having one end pivoted to the threaded rod and another end pivoted to a second connecting rod, and the second connecting rod is pivoted to a press and cutting platen of the press ram.

10. A cutting and shaping press according to claim 1, characterized in that the multiple pivot carrier has slide blocks for guiding the multiple pivot carrier in the press ram.

11. A cutting and shaping press according to claim 1, characterized in that the multiple pivot carrier is guided indirectly by the press ram.

12. A cutting and shaping press according to claim 1, characterized in that the multiple pivot carrier is guided directly by the press ram.

13. A cutting and shaping press comprising a press ram, a press stand, at least one drive cylinder having a piston rod, and a hinged lever drive having at least two knee lever systems connected to the ram and symmetrically arranged with respect to a vertical center plane of the ram, the knee lever systems having fixed points and at least two threaded spindles adjustable in height in the press stand and positioning bearing blocks fitted on ends of the threaded spindles for pivoting one of the fixed points of each of the knee lever systems, the press further comprising a slide device within the press ram, the slide device having a multiple pivot carrier connected to the piston rod of the drive cylinder, and a connecting rod connecting the multiple pivot carrier to a knee joint of each of the knee lever systems, characterized in that the multiple pivot carrier is guided in the press ram, the slide device is supported in the press ram, and the slide device is defined by a bridge for the drive cylinder as well as by slide plates connected with one another and guided in the press ram.

14. A cutting and shaping press according to claim 13, characterized in that the press ram has longitudinal sidewalls, said slide plates are parallel to the longitudinal sidewalls of the press ram, and each slide plate has a central guide for the multiple pivot carrier.

15. A cutting and shaping press according to claim 14, characterized in that the central guides comprise grooves in the slide plates.

16. A cutting and shaping press comprising a press ram, a press stand, at least one drive cylinder having a piston rod, and a hinged lever drive having at least two knee lever systems connected to the ram and symmetrically arranged with respect to a vertical center plane of the ram, the knee lever systems having fixed points and at least two threaded spindles adjustable in height in the press stand and positioning bearing blocks fitted on ends of the threaded spindles for pivoting one of the fixed points of each of the knee lever systems, the press further comprising a slide device within the press ram, the slide device having a multiple pivot carrier connected to the piston rod of the drive cylinder, and a connecting rod connecting the multiple pivot carrier to a knee joint of each of the knee lever systems, characterized in that the multiple pivot carrier is guided in the press ram and the slide device is supported in the press ram, characterized in that the press ram has an upper edge and sides, all of the sides of the press ram consisting of closed surfaces extending up to the upper end of the press ram, the press stand has an inside and corners, and said press ram is open towards the drive cylinder and slides with its sides along guides fitted in fixed positions on the inside of and near the corners of the press stand.

* * * * *